United States Patent [19]

Barth

[11] 4,249,972

[45] Feb. 10, 1981

[54] METHOD FOR MANUFACTURING GIRDLES

[75] Inventor: Harry J. Barth, Dover, Del.

[73] Assignee: Abram N. Spanel, Princeton, N.J.

[21] Appl. No.: 866,092

[22] Filed: Dec. 30, 1977

[51] Int. Cl.[2] ..... B32B 31/20; B29H 3/042; B32B 25/10

[52] U.S. Cl. ..... 156/165; 118/44; 118/215; 128/580; 156/229; 156/232; 156/242; 223/39; 264/137; 264/257; 264/259; 264/301; 427/230

[58] Field of Search ..... 156/213, 214, 215, 232, 156/242, 249, 160, 163, 164, 165, 229, 294; 427/230, 430 R; 264/257, 259, 301, 306; 118/200, 209, 44, 254; 128/521, 580; 223/39, 40, 52

[56] References Cited

U.S. PATENT DOCUMENTS

| | | | |
|---|---|---|---|
| 1,146,638 | 7/1915 | Miller | 156/242 X |
| 1,993,212 | 3/1935 | Edwardes | 264/306 X |
| 2,713,885 | 7/1955 | McKinley | 156/294 X |
| 2,803,056 | 8/1957 | Brissey, Jr. et al. | 156/294 X |
| 2,842,473 | 7/1958 | Oberly et al. | 156/249 X |
| 3,219,038 | 11/1965 | Spanel | 128/521 |
| 3,328,222 | 6/1967 | Ambrose et al. | 156/229 |
| 3,515,613 | 6/1970 | Zucchelli | 156/213 |
| 3,992,570 | 11/1976 | Beinhaur | 156/294 X |

*Primary Examiner*—John T. Goolkasian
*Assistant Examiner*—Thomas Bokan
*Attorney, Agent, or Firm*—Steele, Gould & Fried

[57] ABSTRACT

A method and apparatus for manufacturing lined latex girdles in which one end of a fabric sheath which will form the liner of a latex girdle is sewn or otherwise held closed together and slipped over an annular rectangular frame, with the closed end of the bag disposed in the middle of the annular rectangular frame. A flat form, with curved sides, is first covered with a latex film, and while tacky, is pushed through the frame, engaging the fabric liner. As the form is pushed through the frame, the liner slides over the frame, and contacts the sides of the form. When the form has been pushed completely through the frame, the liner will be supported on the form, which may then be easily withdrawn for final processing. Close tolerances between the dimensions of the form and the frame assist in providing quality control with respect to the interpenetration of the fabric liner and the latex film.

7 Claims, 4 Drawing Figures

METHOD FOR MANUFACTURING GIRDLES

BACKGROUND OF THE INVENTION

I. Field of the Invention

This invention relates to the field of manufacturing girdles, and in particular, to a method and apparatus for applying stretch fabric liners to latex sheath girdles.

II. Prior Art

It is known in the prior art to attach fabric liners to latex sheath girdles by means of cylindrical elements. The form on which the fabric element is stretched is a uniform or perfect cylinder. The form on which the latex film is applied is a cylinder which decreases in diameter, with its narrower end being first inserted into the uniform cylinder and first engaging the fabric element. It may be appreciated that an annular space is created between the outer surface of the form and the inner surface of the edge of this uniform cylinder on which the fabric element is mounted. It may also be appreciated that as the cylindrical form is further inserted into the uniform cylindrical element, the annular space therebetween decreases because the diameter of the cylindrical form increases. This creates an ever-changing annular space, which results in non-uniformity and lack of control over the interpenetration of the fabric element and the latex film. In the apparatus according to the present invention, the form is flat. The only variations in shape are the regularly curved edges, which result in the form being widest in the middle, and narrowest at the ends. By way of further contrast, the uniform cylinder known in the prior art is replaced in the present invention with an annular rectangular frame. The dimensions of the frame and the form are such that in a preferred embodiment there are very close tolerances therebetween, which just permit the form to be inserted through the frame, and then withdrawn. It may therefore be appreciated that the only space between the form and the frame which changes in any appreciable fashion is that between each side edge of the form and each edge of the frame. Due to the close tolerances, the longer sides of the form and the longer sides of the frame are substantially co-extensive. In fact, the circumferential interface between form and frame is constant over approximately 93% as the form travels through the frame since the sides are flat and only the edges are variable. The fabric liner, which is sewn or other-wise held closed so as to be closed at one end and slipped over the frame, is attached to the form as it is moved through the frame. The close tolerance between the form and the frame controls the depth to which the fabric liner is embedded into the latex film covering the form. It is therefore easier to control the uniform application of the fabric element to the latex sheath because the variable of the changing space described above is practically eliminated.

SUMMARY OF THE INVENTION

It is an object of the subject invention to provide a greatly simplified method and apparatus for applying the fabric liners to latex sheath girdles.

It is another object of the subject invention to provide a simplified method and apparatus for attaching a fabric liner to a latex sheath girdle, which application can be accomplished in a "one-step" operation.

It is still another object of the subject invention to provide a latex sheath girdle, with a stretch fabric lining, which has desirable horizontal and vertical stretch characteristics.

It is yet another object of the subject invention to provide a lined, latex sheath girdle having increased horizontal stretchability in the waist area and increased vertical stretchability in the lower back and buttocks area.

It is yet another object of the subject invention to provide a simplified method and apparatus for manufacturing lined latex sheath girdles wherein the interpenetration of the fabric liner and the latex of the sheath is easily and uniformly controlled.

Briefly, the subject invention utilizes a flat form to which latex is applied in forming the latex sheath. The only variations in shape are the curved edges, which result in the form being widest in the middle, and narrowest at the ends. An annular rectangular frame is utilized for holding the fabric liner, which is preferably a seamless sheath or sleeve, one end of which has been sewn or otherwise held together. The fabric liner is slipped over the frame, with the seamed end in the middle thereof. While the latex on the form is still tacky, the form is inserted through the frame, engaging the fabric liner at the sewn seam. As the form moves through the frame, the fabric liner slides over the edges of the frame and contacts the sides of the form. When the form has been fully inserted through the frame, the liner has been completely transferred onto the form. Close tolerance between the form and the frame just permit the form to be inserted therethrough, and at the same time, provide a means for automatically controlling the interpenetration of the fabric liner and the tacky latex film. In alternative embodiments, the frame is provided with either inwardly directed rollers or brushes, which provide the close tolerances with the form.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

BRIEF DESCRIPTION OF THE PREFERRED EMBODIMENTS

Figure 1:
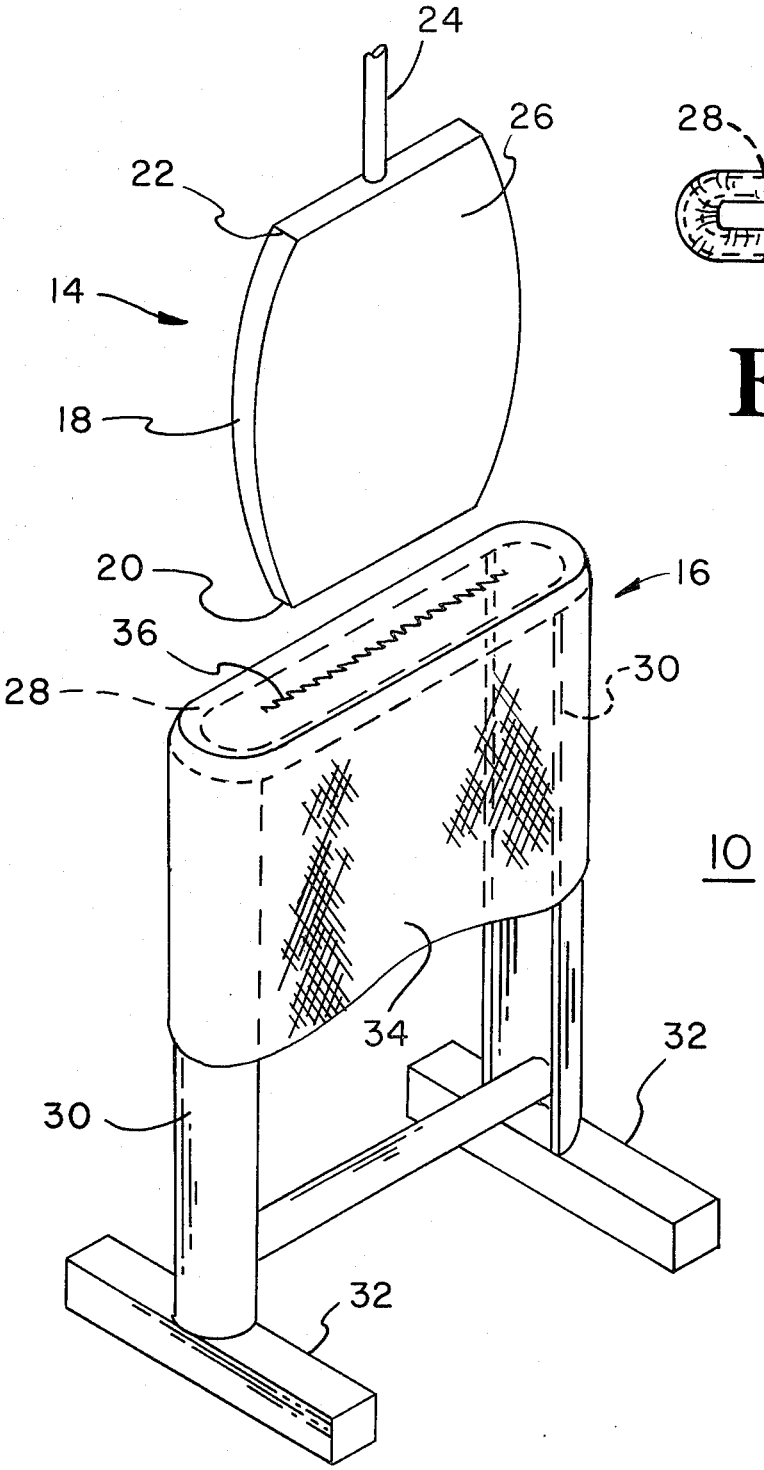
FIG. 1 is a perspective view of an apparatus for applying fabric liners to latex girdles in accordance with the present invention.

A girdle forming apparatus according to one of the presently preferred embodiments of the present invention is shown in FIG. 1, and generally designated by numeral 10. The apparatus 10 is basically comprised of a form member generally designated 14 and a lower section generally designated by numeral 16.

The girdle form 14 is flat, and may be made from metal or plastic. The girdle form 14 is widest near the middle thereof, at the place indicated by numeral 18. The form is substantially curved toward its top and bottom, to narrower end portions shown by numerals 20 and 22. The numeral 22 corresponds to that part of the girdle form 14 on which the waist portion of the girdle is formed. The form is provided with an attachment member 24, by means of which the form 14 may be supported and thereby transported during the various phases of the girdle manufacture. During the course of girdle manufacture, the form 14 has a latex film applied to it, preferably by dipping, which layer of latex film is designated by numeral 26. The film is on the front, back, side edges and bottom edge of the form. The latex film 26 may also be on the upper edge of the form, with respect to the orientation of FIG. 1, but this is of no consequence in the girdle making process.

The lower section 16 has an annular, rectangular, tubular frame member 28, best described as a squashed hoop 28. Frame 28 is supported by support members 30. When two support members 30 are utilized, as shown in FIG. 1, they may be attached to an H-shaped base 32 or other suitable support. The seamless fabric element 34, which is to become the fabric lining of a seamless latex girdle, and is preferably a two-way stretch fabric, has one of its ends stitched or otherwise held closed, as shown by numeral 36. The "bag" then formed by the fabric element is slipped over the frame 28, until the seam or connections 36 are substantially centered within the squashed hoop 28, as shown in FIG. 1.

The dimensions of the form 14 and frame 28 are such that there may be close tolerance which just permit the form 14 to be inserted through the frame 28, and then withdrawn. This close tolerance along with uniformity of annular space helps to control the depth to which the fabric element 34 is embedded into the latex film covering the form 14. As is known in the art, the extent to which the latex film seeps or is pushed into the fabric element, or conversely, the extent to which the fabric element is embedded into the latex film, determines the overall stretch characteristics of the complete girdle laminae.

The form 14 is firstly covered with a latex film, preferably by dipping same into a vat. This forms the base latex sheath. At the same time, the fabric element 34, which is to become the inner cloth lining for the girdle, is also prepared. Preferably, the fabric element 34 is a seamless two-way stretch knitted sheath. One end of the sheath is closed on itself, such as by the basting stitches shown as numeral 36. The sheath, which is then in the form of a bag, is slipped over the frame of the lower section. With the latex film still wet or tacky, either from dipping or from the application of heat at a time subsequent to dipping, the form 14, by means of member 24, is pushed downward substantially through the center of the frame 28. As the form travels through the frame, the seam formed by connections 36 will be engaged by the lower edge of the form, and will be pushed downwardly with the form. As the form moves further downward, the fabric element 34 will be pulled over the edges of the frame. At the same time, and at a point adjacent or close to the level of the frame, the fabric element 34 will be brought into contact with the sides and edges of the form 14. By the time the form 14 has been pushed completely through the frame, the fabric element 34 will be completely attached to the form, and will be completely free of the elements of the lower section 16. The form, with the fabric lining then attached, may then be easily withdrawn from the lower section, and may be moved to the final processing operations. If necessary, the fabric may be rolled or brushed against the latex by mechanical or hand operated means to obtain a better bond and remove any wrinkles, creases or other irregularities. This final operation further entails, basically, removing the latex and fabric element from the form so that the garment may then be trimmed and finished, which operations would include removing the connection means 36 and trimming the excess latex and fabric.

The ease in quality maintenance with respect to the depth of interpenetration between the fabric element and the latex film on the form and control of prestressing may be appreciated by a comparison of the present apparatus with the cylindrical apparatus known in the prior art. In such prior art apparatus, the form on which the fabric element was first stretched was a perfect cylinder. The form on which the latex film was applied was a cylinder which decreased in diameter, with the narrower end of the form being first inserted into the cylinder and first engaging the fabric element. It may be appreciated that an annular space is created between the outer surface of the form and the inner surface of the edge of the cylinder mounting the fabric element. It may also be appreciated that as the cylindrical form is further inserted into the uniform cylindrical element, the annular space therebetween decreases because the diameter of the cylindrical form increases. This creates an everchanging annular space, which as an added variable makes uniformity and control over the interpenetration of the fabric element and the latex film and control over prestressing characteristics of the fabric more difficult. In the apparatus according to the present invention, the form is flat. The only variations in shape are the regularly curved edges, causing the form to be widest in the middle and narrowest at the ends, as noted hereinbefore. It may be appreciated that the only space between the form and the frame which changes in any appreciable fashion is that between each side edge of the form and each edge of the frame. Due to the close tolerances, the longer sides of the form and the longer sides of the frame are substantially co-extensive. In fact, the circumferential interface between the form and the frame is constant over approximately 93% of the total interface. It is therefore easier to control the uniform application of the fabric element to the latex sheath because the variable of the changing space described above is practically eliminated.

The present method also provides significant advantages in that it is easier to remove vertical stretch from areas of the finished girdle where such stretch is undesirable, and it is easier to increase horizontal stretch in areas where horizontal stretch is desirable, such as in the waist portion. As noted hereinbefore, the lower end of the form, which is one of the two narrower ends thereof, corresponds to the waist portion. In use, this narrower portion must be easily pulled over the hips of the user. As is known, the stretchability of the fabric, as applied to the latex, is affected by the extent to which the fabric is stretched when applied. The unique method according to the present invention takes advantage of this characteristic, and obviates the difficulty of pulling the narrower waist portion over the hips.

The foregoing is demonstrated in the following tables. Table 1 has listed therein the % vertical and horizontal stretch produced in the fabric lining when applied in accordance with the present invention. The data is listed beginning from the waist portion of the girdle, with substantially even increments moving towards the bottom section of the girdle.

TABLE 1

| | VERTICAL STRETCH | HORIZONTAL STRETCH |
|---|---|---|
| From waist | 44% | 10% |
| | 40% | 20% |
| | 30% | 28% |
| | 28% | 34% |
| | 26% | 40% |
| | 18% | 45% |
| | 20% | 45% |
| | 15% | 45% |
| | 16% | 42% |
| | 8% | 40% |
| | 5% | 38% |
| | 2% | 36% |
| | 0% | 36% |
| | −12% | 28% |

It is known in the art that the overall stretchability of a latex sheath, without a fabric lining or stiffener is on the order of 700–800 percent. In Table 2, there is listed the stretch characteristics of the total girdle laminae, fabric and latex as a percent (%) of the unstressed dimensions of the laminae.

TABLE 2

| | VERTICAL STRETCH | HORIZONTAL STRETCH |
|---|---|---|
| Waist Section | 77% | 243% |
| Middle Section | 100% | 195% |
| Bottom Section | 135% | 175% |

As noted before, the waist area is one particular area where horizontal stretch is very desirable, but vertical stretch is not nearly as desirable. Reference to Table 2 shows that the horizontal stretchability in the waist portion is 243%, as compared to only 195% and 175% in the middle and bottom sections respectively. Vertical stretch is most desirable in the middle and bottom sections of the girdle, in order to facilitate sitting down. In this respect, Table 2 shows that the vertical stretchability in the middle and bottom sections is 100% and 135% respectively, as compared to only 77% in the waist section.

It is often necessary, in prior art methods, to mechanically or hand roll or brush the fabric in order to work it into the latex film after the application of the fabric to the latex has been made. The method according to some of the embodiments of the present invention, to the contrary, provides a "one-step" operation, whether it be a hand operation or a mechanical operation.

Figure 2:
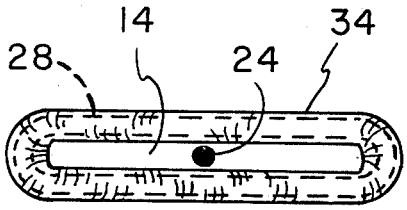
FIG. 2 is a top view of the apparatus shown in FIG. 1.
Figure 3:
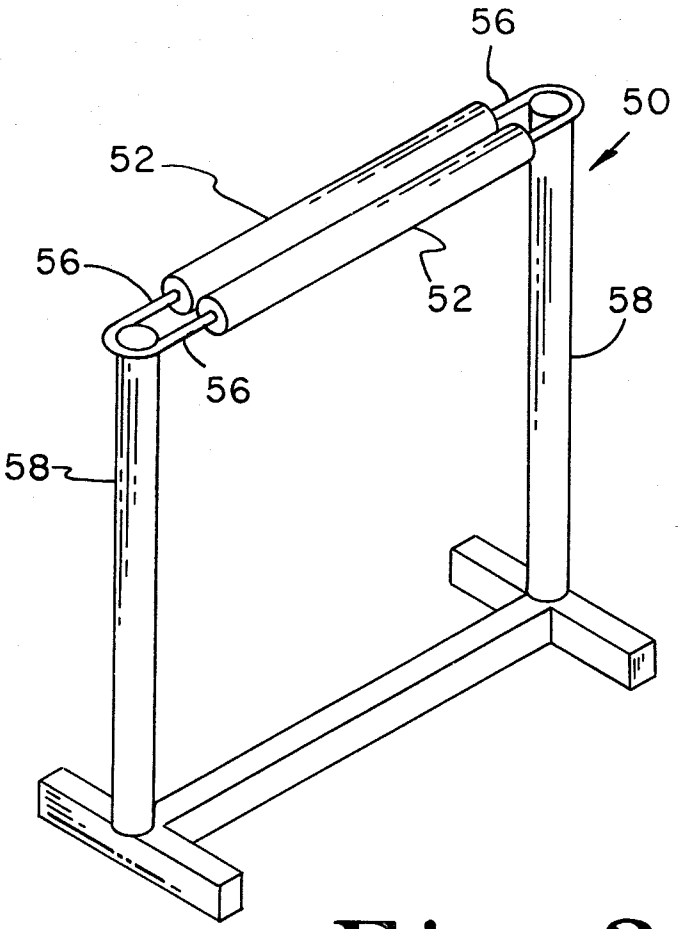
FIG. 3 is a perspective view of an alternative embodiment of the lower section of the apparatus shown in FIG. 1; and, FIG. 4 is a perspective view of another alternative embodiment of the lower section of the apparatus shown in FIG. 1.

There are two other presently preferred embodiments for performing the process according to the present invention, in addition to that shown in FIGS. 1 and 2. With reference to FIG. 3, a lower section, generally designed by numeral 50, is provided with rollers. Rather than utilizing a frame shaped like a squashed hoop which is itself manufactured according to desired close tolerances, the close tolerances are provided by two opposing rollers 52. The rollers are provided with U-shaped roller mounting means 56, which are attached to support members 58. The support members may themselves be supported in a manner similar to lower section 16 in FIG. 1.

During the method of forming a girdle according to the present invention, the fabric bag is formed so that the connection members or seam 36 is disposed between the rollers 52. Similarly, the form 14 is inserted between the rollers. Thus the need for subsequent rolling may be eliminated by this one step process.

Figure 4:
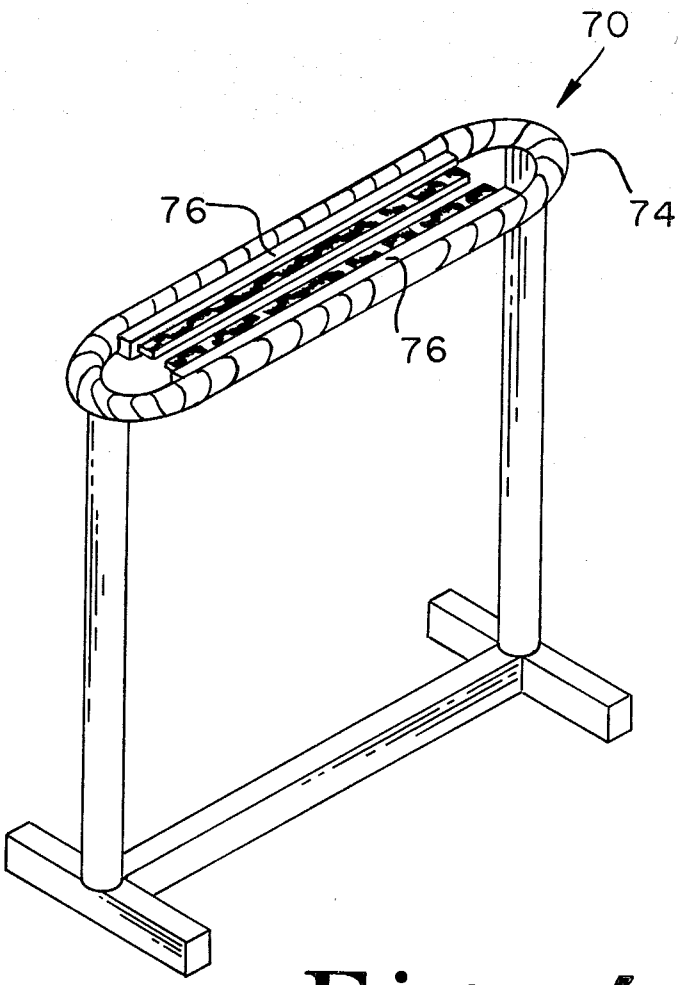

The third of the presently preferred embodiments is shown in FIG. 4, and is generally designated by numeral 70. This embodiment is similar to that shown in FIG. 3, except that brush elements are used instead of rollers. Brush elements 72 are held inside a somewhat enlarged squashed hoop 74 by brush mounting means 76. The hoop and brush assembly of this embodiment may also be supported in a manner similar to the first two described embodiments.

The advantages provided by the second and third embodiments are similar. Both the rollers and brushes provide a rolling, brushing or rubbing action which assures the proper interpenetration of the fiber mesh of the fabric and the latex film on the form.

The present invention may be embodied in other specific forms without departing from the spirit or essential attributes thereof, and accordingly, reference should be made to the appended claims, rather than to the foregoing specification as indicating the scope of the invention.

I claim:

1. A method for manufacturing girdles, comprising the steps of:

forming an adherable latex sheath on a flat form member having curved edges and being widest near the middle thereof;

placing a fabric liner having a substantially closed end over a frame member, the frame member having an opening comprising structure of two parallel sides and two joining ends and being of sufficient size to receive the form member which has two parallel sides, moving the form member through the opening in the frame member, such that the circumferential interface between the form and the frame member remains constant for approximately 93% of the total interface, thereby engaging the closed end of the liner, and pulling the liner through the opening in the frame member and into contact with the coated form member; and transferring the fabric liner from the frame member to the coated form member.

2. The method of claim 1, wherein the frame opening and form member have relatively close tolerance in dimension which permits the form member to be inserted through the frame opening, thereby further comprising the step of controlling the application of the fabric liner to the latex sheath.

3. The method of claim 1, further comprising the step of moving the form member back out through the frame opening.

4. The method of claim 1 further comprising the step of friction rolling the fabric liner into the tacky latex sheath by rollers being actuated by movement of the fabric covered form member.

5. The method of claim 1 further comprising the step of brushing the fabric liner into the tacky latex sheath.

6. The method of claim 1 further comprising the step of obtaining a fabric liner with a closed end by sewing the fabric liner to form a closed end.

7. The method of claim 1 wherein said frame member has side supports with open spaces below the parallel sides of the opening thereby further comprising the step of allowing said fabric liner to be transferred to the coated form member from the frame member with less than total surface area movement of the fabric liner against said frame member.

* * * * *